United States Patent [19]

Ezoe

[11] 4,127,088

[45] Nov. 28, 1978

[54] CLOSED-LOOP EMISSION CONTROL APPARATUS FOR MULTI-CYLINDER INTERNAL COMBUSTION ENGINES HAVING A PLURALITY OF EXHAUST SYSTEMS

[75] Inventor: Mitsuhiko Ezoe, Yokosuka, Japan

[73] Assignee: Nissan Motor Company, Limited, Japan

[21] Appl. No.: 752,147

[22] Filed: Dec. 20, 1976

[30] Foreign Application Priority Data

Dec. 25, 1975 [JP] Japan ..... 50-154098

[51] Int. Cl.[2] ..... F02B 3/08; F02M 7/12; F01N 3/08

[52] U.S. Cl. ..... 123/32 EE; 123/119 EC; 60/276; 60/285

[58] Field of Search ..... 123/32 EE, 32 EK, 32 EB, 123/32 EA, 119 E, 119 EC; 60/276, 285

[56] References Cited

U.S. PATENT DOCUMENTS

| | | | |
|---|---|---|---|
| 3,815,561 | 6/1974 | Seitz | 123/32 EE |
| 3,903,853 | 9/1975 | Kizler et al. | 60/285 |
| 3,938,075 | 2/1976 | Reddy | 123/32 EK |
| 3,938,479 | 2/1976 | Oberstadt | 123/32 EE |
| 3,955,363 | 5/1976 | Manderscheid | 60/285 |
| 4,024,707 | 5/1977 | Schmidt et al. | 60/276 |
| 4,040,408 | 8/1977 | Kraus et al. | 60/276 |

*Primary Examiner*—Charles J. Myhre
*Assistant Examiner*—P. S. Lall

[57] ABSTRACT

A closed-loop emission control apparatus for a multi-cylinder internal combustion engine having a plurality of exhaust systems includes an exhaust composition sensor for each exhaust system and a failure detector responsive to the output from each exhaust composition sensor. The air-fuel ratios of the exhaust systems are controlled by a signal whose amplitude is representative of a mean value of the concentration values of the exhaust composition sensed by both working sensors, and in response to the output from the failure detector the ratios are controlled by a valid signal from a working sensor should the other fail.

7 Claims, 4 Drawing Figures

TO MIXING DEVICE 9a
TO MIXING DEVICE 9b
+Vcc
Q6
Q7
Q6'
Q7'
22a
22b
R12
R14
R12'
R14'
QA
QB
QA'
QB'
R11
R13
R11'
R13'
23
Q5
Q4
R10
R9
R8
D3
C6
C5
R7
21a
21b
FROM CONT. 20a
FROM CONT 20b

CLOSED-LOOP EMISSION CONTROL APPARATUS FOR MULTI-CYLINDER INTERNAL COMBUSTION ENGINES HAVING A PLURALITY OF EXHAUST SYSTEMS

FIELD OF THE INVENTION

The present invention relates generally to automotive emission control systems and in particular to emission control apparatus for a multi-cylinder internal combustion engine having at least two exhaust systems each with an exhaust composition detector to provide individual closed-loop control of the mixture ratio of air and fuel to be supplied to the cylinders of the engine associated with respective one of the exhaust systems.

BACKGROUND OF THE INVENTION

The concentration of an exhaust composition in the emissions from an internal combustion engine has been used as a signal to represent the ratio of the air-fuel mixture in order to control the mixture ratio in the neighborhood of the stoichiometric value in order to reduce the noxious components to a minimum. In multi-cylinder internal combustion engines in which the cylinders are equally divided into two groups for separate emission of exhaust gases, an exhaust composition sensor is provided for each exhaust system because of the difference in the air-fuel ratio between the exhaust systems arising from the possible different mechanical tolerances or workmanship. In such systems, air-fuel ratios of the exhaust systems are separately feedback-controlled, and if one of the exhuast composition sensors should fall, the cylinders associated with the defective sensor will be supplied with a rich or lean mixture depending upon the type of failure. As a result noxious emissions will be produced even though the other exhaust system is functioning properly and drivability is also impaired.

SUMMARY OF THE INVENTION

It is therefore an object of the present invention to eliminate the above-mentioned disadvantage by providing a failure detector for each of the exhaust systems in order to control the air-fuel ratios of the separate exhaust systems in response to the concentration of the exhaust composition sensed by the working exhaust composition sensor.

It is another object of the invention to provide emission control apparatus in which an averaging circuit is provided to generate an output with an amplitude representative of a mean value of the concentration values of the exhaust compositions sensed by the separate exhaust composition sensors, the output from the averaging circuit being applied to air-fuel mixing devices associated with the separate groups of cylinders when both sensors are functioning properly and a signal representative of the concentration of the composition sensed by a working sensor being applied to both air-fuel mixing devices in the case of a failure in the other sensor.

BRIEF DESCRIPTION OF THE DRAWINGS

The invention will be further described by way of examples in conjunction with the accompanying drawings, in which.

DESCRIPTION OF THE PREFERRED EMBODIMENTS

Figure 1:
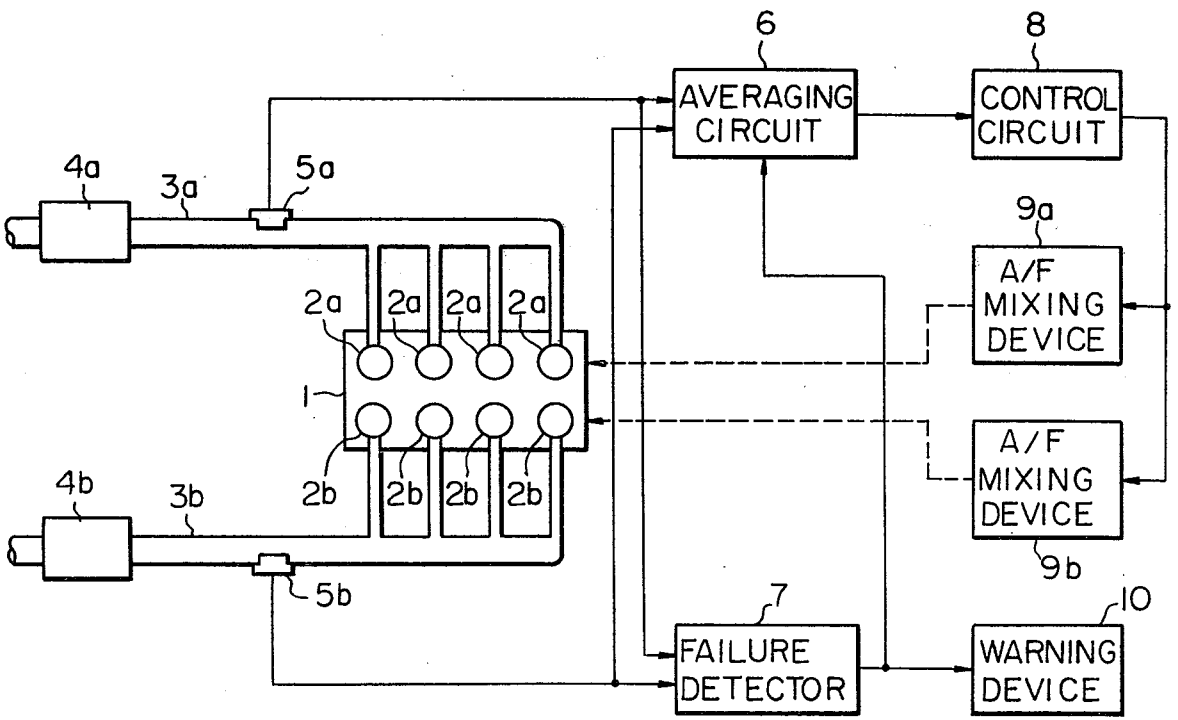
FIG. 1 is an embodiment of the present invention in schematic form.

Referring now to FIG. 1, an embodiment of the present invention is schematically shown. Numeral 1 indicates an eight-cylinder internal combustion engine with half of its cylinders 2*a* associated with an exhaust system including an exhaust pipe 3*a* and the remainder of the cylinders 2*b* associated with an exhuast system including an exhaust pipe 3*b*. Catalytic converters 4*a* and 4*b* are connected to the exhaust pipes 3*a* and 3*b*, respectively. Exhaust gas sensors such as oxygen sensors 5*a* and 5*b* are provided on the exhaust pipes 3*a* and 3*b*, respectively, to detect the residuous oxygen concentration of the exhaust emissions and provide oxygen-content representative voltage signals to an averaging circuit 6 and a failure detector 7. The averaging circuit 6 produces an output signal with an amplitude which is an average value of the two input voltages and applies it to a control circuit 8 which provides its output to air-fuel mixing devices 9*a* and 9*b*. The mixing devices 9*a* and 9*b* supply air-fuel mixtures to the group of cylinders 2*a* and the group of cylinders 2*b*, respectively.

When one of the exhaust gas sensors 5*a* and 5*b*, ceases functioning properly the failure detector 7 senses it and generates an output signal which is applied to the averaging circuit 6 in order to pass the signal from the sensor which is functioning properly to the control circuit 8. The signal from the failure detector 7 is also fed to a warning device 10.

Figure 2:
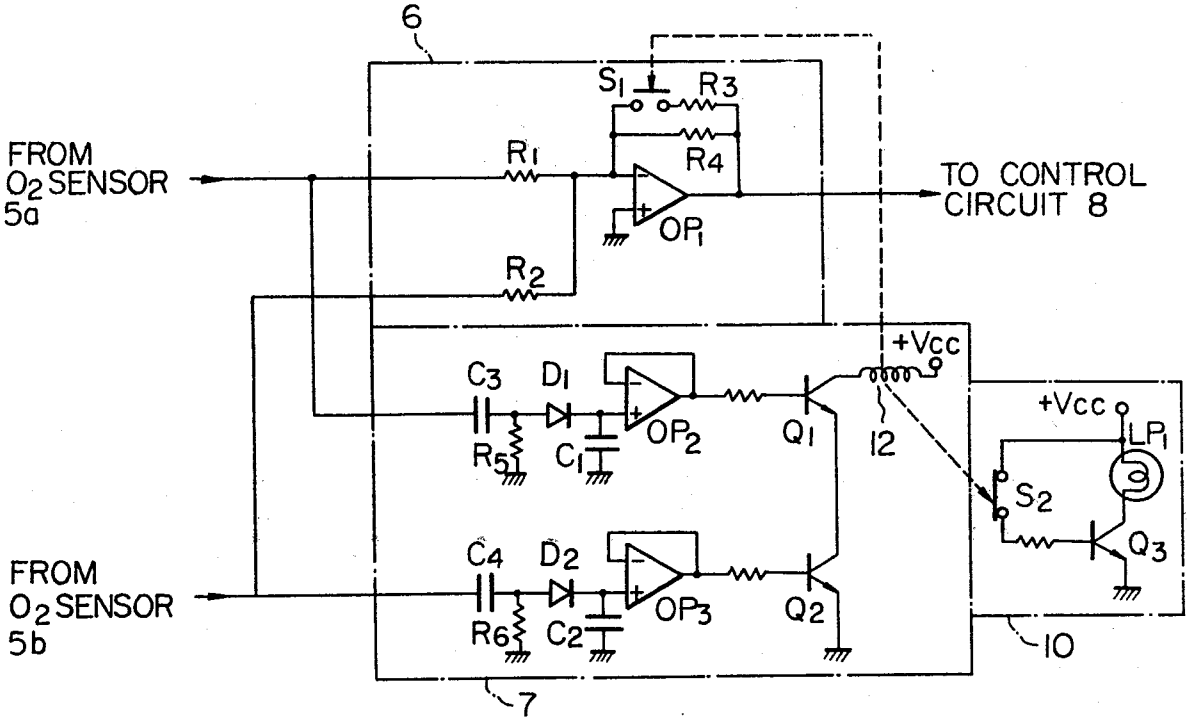
FIG. 2 is a circuit diagram of a portion of the embodiment of FIG. 1.

In FIG. 2, the average circuit 6 is shown as comprising an operational amplifier OP1 having its inverting input connected through resistor R1 to the output of exhaust gas sensor 5*a* and through resistor R2 to the output of exhaust gas sensor 5*b* and its noninverting input connected to ground. The inverting input of the operational amplifier OP1 is connected through a switched resistor network to its output terminal. The resistor network comprises resistors R3 and R4 which are brought into parallel connection through a normally open relay contact unit S1. Operational amplifier OP1 has the function of summing up the two input signals applied to its inverting input terminal and dividing the sum of the input signals by the factor of two as determined by the combined resistance value of the resistors R3 and R4 when parallel connected, and also function to provide a unity gain amplification of the input signal when resistor R3 is disconnected.

The failure detector 7 comprises operational amplifier OP2 and OP3 with their outputs connected to the base of transistors Q1 and Q2 respectively. The output from the exhaust gas sensor 5*a* is connected through a capacitor C3 to the anode of a diode D1 with its cathode connected to the noninverting input of the operational amplifier OP2. The junction between the capacitor C3 and the diode D1 is connected to ground through a resistor R5 to constitute a differentiating circuit with the capacitor C3. A storage capacitor C1 is connected between the noninverting input of operational amplifier OP2 and ground. The inverting input of operational amplifier OP2 is connected to its output to form a buffer amplifier. Similarly, the output from the exhaust gas sensor 5*b* is connected through a capacitor C4 to the anode of a diode D2 with its cathode connected to the noninverting input of operational amplifier OP3. The junction between the capacitor C4 and the diode D2 is grounded through a resistor R6 which constitutes a differentiating circuit with the capacitor C4. A storage capacitor C2 is connected between the noninverting input of operational amplifier OP3 and ground. A relay coil 12 is connected between a voltage supply Vcc and the collector of transistor Q1 whose emitter is connected to the collector of transistor Q2 with its emitter being connected to ground.

When the exhaust gas sensors 5*a* and 5*b* are both functioning properly, their outputs vary in amplitude at periodic intervals so that both differentiating circuits C3, R5 and C4, R6 provide differentiated outputs through diodes D1 and D2, respectively, to charge storage capacitors C1 and C2. The transistor Q1 is turned on when the output of amplifier OP2 reaches its threshold voltage of the pn junction. Similarly, the transistor Q2 is turned on when the output of amplifier OP3 reaches its threshold voltage of the pn junction to draw current through the relay coil 12. The energization of the relay coil 12 closes the contact unit S1 so that resistors R3 and R4 are connected in parallel. The combined resistance value is selected such that the operational amplifier OP1 delivers an output with amplitude which is an average value of the two input voltages supplied from the exhaust gas sensors 5*a* and 5*b*. The control circuit 8 is fed with the mean value of the output voltages of the oxygen sensors from which it derives a control signal that is applied to the A/F mixing devices 9*a* and 9*b*.

If it is assumed that the oxygen sensor 5*a* ceases to function properly and consequently generates no output, the differentiated signal ceases to occur and the capacitor C1 will no longer develop a voltage sufficient to drive transistor Q1 into conduction and deenergizes the relay coil 12. The relay contact S1 opens so that resistor R3 is disconnected. With only resistor R4 remains connected, the operational amplifier OP1 operates as a unity gain amplifier so that its output is a unity gain amplification of the input signal from the exhaust composition sensor 5*b*. Therefore, when one of the oxygen sensors fails to operate properly, the control circuit 8 is fed with a signal from the working oxygen sensor from which it drives a control signal for the A/F mixing devices 9*a* and 9*b*.

When one of the sensors 5*a* and 5*b* becomes faulty, a relay contact S2 completes a circuit that turns on transistor Q3 to light up a lamp LP1 in the warning device 10 so that the vehicle driver is made aware of the faulty condition of an exhaust gas sensor.

Figure 3:
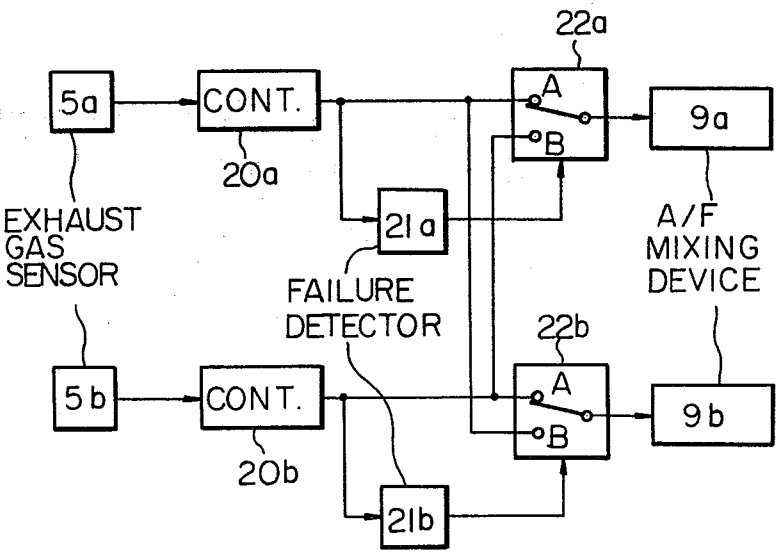
FIG. 3 is a modification of embodiment of FIG. 1.

FIG. 3 shows a modification of the embodiment of FIG. 1 in which similar parts to those shown in FIG. 1 are indicated by the same numerals as used in FIG. 1. The outputs from the exhaust gas sensors 5*a* and 5*b* are connected to control circuits 20*a* and 20*b*, respectively, to provide output signals each of which is a modification of the amplitude of input signals. The output from the control circuit 20*a* is connected on the one hand to a failure detector 21*a* and thence to a control input of a switching device 22*a* and on the other hand to the A position of the switching device 22*a* and to the B position of a switching device 22*b*. Similarly, the output from the control circuit 20*b* is connected on the one hand to a failure detector 21*b* and thence to a control input of the switching device 22*b* and on the other hand to the A and B positions of the switching devices 22*b* and 22*a*, respectively. The switching devices 22*a* and 22*b* are each provided with a moving contact arm which is normally connected to the A position to apply the input signal from the control circuit 20*a* to the corresponding air-fuel mixing device 9*a* and the input signal from control circuit 20*b* to the corresponding air-fuel mixing device 9*b*. Under normal conditions, therefore, air-fuel mixing devices 9*a* and 9*b* are separately operated by the signals fed from the control circuits 20*a* and 20*b*, respectively.

When the exhaust gas sensor 5*a* should fail, for example, the failure detector 21*a* detects it and provides a control signal to the switching device 22*a* to connect the output from the control circuit 20*b* to the air-fuel mixing device 9*a*, while disconnecting the circuit between the output from control circuit 20*a* and the air-fuel mixing device 9*a*, so that air-fuel mixing devices 9*a* and 9*b* are both operated with the signal from the control circuit 20*b*. Conversely, when failure occurs in the exhaust gas sensor 5*b*, the failure detector 21*b* provides an output to the switching device 22*b* so that both air-fuel mixing devices are operated with the signal from the exhaust gas sensor 5*a*.

Figure 4:
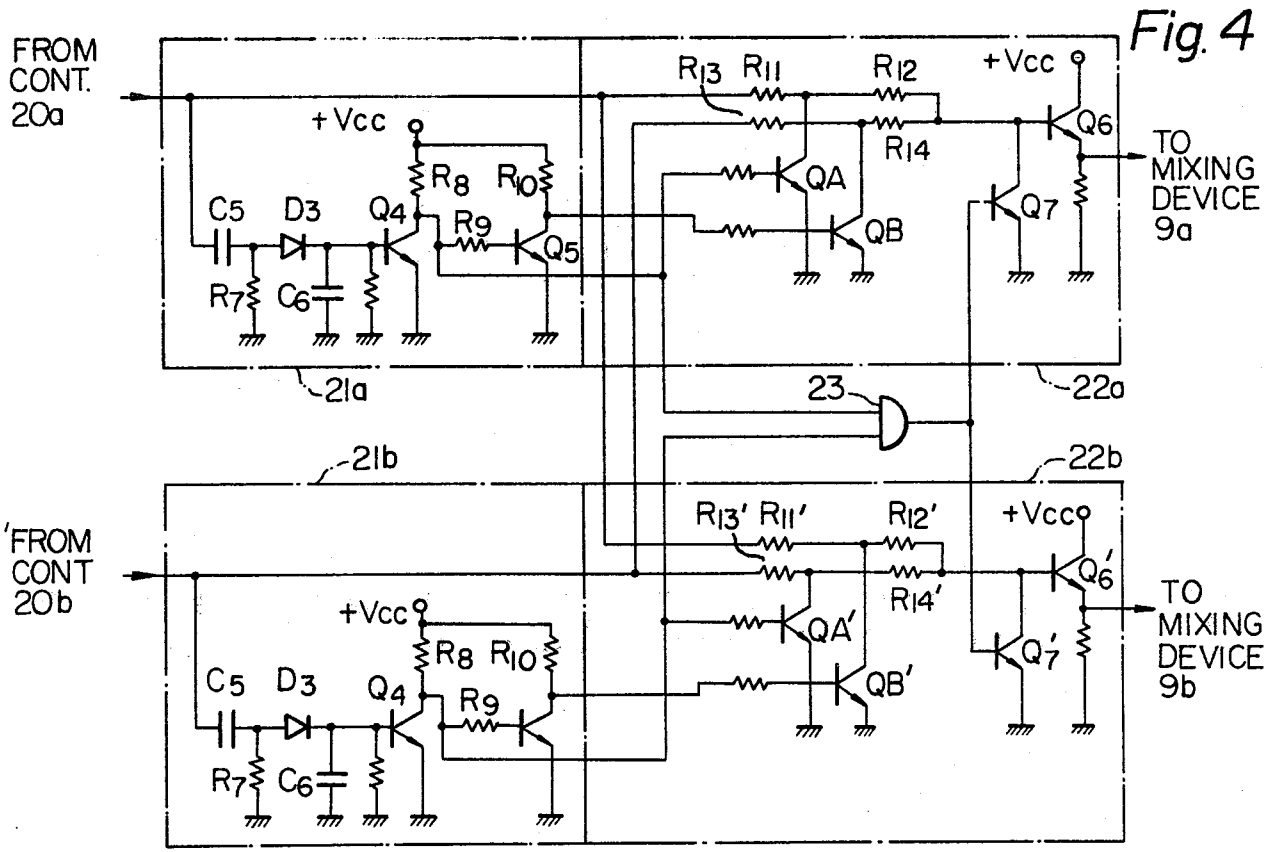
FIG. 4 is a circuit diagram of a portion of the circuit of FIG. 3.

An example of the failure detectors 21*a* and 21*b*, and switching devices 22*a* and 22*b* is illustrated in FIG. 4. Each of the failure detectors 21*a* and 21*b* comprises a transistor Q4 having its base connected to the output of control circuit 20 through capacitor C5 and diode D3 and its collector connected to the voltage supply Vcc through load impedance R8 and to the base of a transistor Q5 through resistor R9. The emitter of transistors Q4 and Q5 is connected to ground. Transistor Q5 has its collector connected to the voltage supply Vcc through load impedance R10. A resistor R7 is connected across the junction between capacitor C5 and the anode of diode D3 and ground to constitute a differentiating circuit with the capacitor C5. A storage capacitor C6 is connected across the cathode of diode D3 and ground in order to store charge which builds up in response to the differentiated signal passing through the diode D3. When the stored charge has reached the threshold level of transistor Q4, transistor Q4 turns on and transistor Q5 turns off.

The switching device 22*a* includes transistors QA and QB having their base electrodes connected to the collector of transistors Q4 and Q5, respectively, and their emitters connected to ground. The output from the control circuit 20*a* is connected through series-connected resistors R11 and R12 to the base of an emitter-follower transistor Q6 and the output from the control circuit 20*b* is connected through series-connected resistors R13 and R14 to the base of the transistor Q6. The collectors of transistors QA and QB are connected to the junction between resistors R11 and R12 and to the junction between resistors R13 and R14, respectively to provide ground potential when conductive to the associated junction point to prevent the application of the signal from the control circuit 20*a* or 20*b* to the transistor Q6 depending on the conductive states of transistors QA and QB.

Similarly, switching device 22*b* includes transistors QA' and QB' having their base electrodes connected to collectors of transistors Q4 and Q5 of failure detector 21*b*, respectively, and their emitters connected to ground and their collectors connected to the junction of series-connected resistors R13' and R14' and to the junction of series-connected resistors R11' and R12', respectively. The output from control circuit 20*a* is further connected through resistors R11' and R12' to the base of transistor Q6' of switching device 22b and the output from the control circuit 20b is further connected through resistors R13' and R14' to the base of the transistor Q6'. The emitters of transistors Q6 and Q6' are connected to the air-fuel mixing devices 9a and 9b, respectively.

When the oxygen sensors 5a and 5b are functioning properly, the output from the sensors 5a and 5b will fluctuate at periodic intervals as described above, and charge is stored in the capacitors C6 in response to the change of signal level at the output of the sensors 5a and 5b. Therefore, under normal conditions transistor Q4 is turned on and transistor Q5 is turned off. As a result, transistor QA of switching device 22a turns off while transistor QB turns on. Likewise, transistor QA' turns off, while transistor QB' turns on. Therefore, the potential at the junction between resistors R13 and R14 of switching device 22a is at the ground potential and no signal is passed to the base of transistor Q6 from the control circuit 20b and likewise the potential at the junction between resistors R11' and R12' of switching device 22b is at the ground potential to prevent the output from the control circuit 20a from being applied to base of transistor Q6', so that the air-fuel mixing devices 9a and 9b are operated with the control signal from the control circuits 20a and 20b, respectively.

The occurrence of a failure in the oxygen sensor 5a, for example, is represented by a voltage drop across the storage capacitor C6 of failure detector 21a and the conductive states of transistors Q4 and Q5 of failure detector 21a are reversed, and consequently the conductive states of transistors QA and QB are reversed to apply ground potential to the junction between resistors R11 and R12 while removing the ground potential from the junction between resistors R13 and R14. Therefore, the signal from the control circuit 21b is coupled to the base of transistor Q6 via resistors R13 and R14 instead of from control circuit 21a.

Although it is very seldom that both exhaust systems including exhaust gas sensors 5a and 5b should fail, it is preferable to provide an arrangement which ensures against such simultaneous failure of the exhaust gas sensors. To this end, the collector of transistors Q4 of the failure detectors 21a and 21b is connected to an AND gate 23 whose output is connected to the base of a transistor Q7 of switching device 22a and to the base of a transistor Q7' of switching device 22b. The base of transistor Q6 is connected through the collector-emitter path of transistor Q7 to ground and the base of transistor Q6' is similarly connected through the collector-emitter path of transistor Q7' to ground.

Should both oxygen sensors fail, transistors Q4 of failure detectors 21a and 21b will turn off so that the potential at their collectors rises to the high level and AND gate 23 is activated to turn on transistors Q7 and Q7' simultaneously to forcibly clamp the base of both transistors Q6 and Q6' to the ground potential and as a result no output is delivered to the mixing devices 9a and 9b. Under this condition, the mixing devices are operated under open loop control rather than the mixing devices are allowed to operate with the false signal. In the open loop control, the air-fuel mixing devices 9a and 9b both operate in a manner identical to conventional carburetors or conventional electronic fuel injection devices.

What is claimed is:

1. A mixture control system for an internal combustion engine having first and second banks of cylinders, first and second exhaust systems connected for emission of the gases from the cylinders of the first and second banks respectively, and first and second air-fuel supplying means for supplying air and fuel to said cylinders of the first and second banks in a variable ratio in response to a control signal, comprising:

first and second exhaust gas sensors disposed in said first and second exhaust systems respectively to provide an output representative of the concentration of a predetermined constituent gas of the emissions in the respective exhaust systems, said output varying in amplitude between first and second voltage levels in response to variations of air-fuel ratio within the respective exhaust system;

detecting means for detecting when the output of either one of said sensors remains invariable for a period of time exceeding a predetermined time period which represents a failure of the exhaust gas sensor; and amplifier means for providing a control signal having a mean value of a summation of the magnitude of said outputs from said first and second exhaust gas sensors in response to the absence of an output from said detecting means and for varying said control signal to a value which corresponds to a unity gain amplification of the output from the other one of said exhaust gas sensors in response to the presence of the output from said detecting means.

2. A mixture control system as claimed in claim 1, wherein said detecting means comprises first and second storage capacitors, first and second diodes connected to said first and second exhaust gas sensors for charging said first and second storage capacitors respectively in response to the outputs thereof, and means responsive to the voltage developed in said first and second storage capacitors for generating a failure detection signal when one of said voltages falls below a predetermined level.

3. A mixture control system as claimed in claim 2, wherein said detecting means includes a first differentiating circuit and a first diode connected in series between the output of said first exhaust gas sensor and said first storage capacitor, and a second differentiating circuit and a second diode connected in series between the output of said second exhaust gas sensor and said second storage capacitor.

4. A mixture control system as claimed in claim 1, wherein said control signal generating comprises an operational amplifier having first and second input terminals and an ouput terminal, a switched resistor network having first and second resistance values connected between the first input terminal and the output terminal of said operational amplifier, means for switching from said first to said second resistance values in response to the output of said detecting means, the second input terminal of said operational amplifier being biased at a reference potential and the first input terminal being connected via first and second resistors to said first and second exhaust gas sensors respectively to provide summation in magnitude of the outputs from said sensors, said first resistance value being such that said operational amplifier delivers an output which is a mean value of said summation when said network has said first resistance value, and said second resistance value being such that said operational amplifier has a unity amplification gain when said nework has the second resistance value.

5. Emission control apparatus for an internal combustion engine having at least two groups of cylinders and respective exhaust systems each of which is associated with a respective one of the groups of the cylinders, wherein each of the exhaust systems includes sensing means for sensing concentration of an exhaust composition in emissions from the engine representative of mixture ratio of air to fuel, and means for mixing air and fuel in accordance with the sensed concentration of the exhaust composition, the apparatus comprising:

function detecting means responsive to the concentration of the exhaust composition sensed by respective ones of said exhaust composition sensing means for detecting whether individual ones of said exhaust composition sensing means are functioning properly; and means for generating a first signal representative of a mean value of concentrations of the exhaust compositions sensed by said exhaust composition sensing means associated with said exhaust systems when all of said sensing means are functioning properly and a second signal representative of concentration sensed by those of said exhaust composition sensing means which are or is functioning properly in response to an output from said function detecting means, and means for applying said first signal in absence of said second signal and alternatively said second when present to said air-fuel mixing means;

wherein said function detecting means includes means responsive to changes in level of the sensed concentration of exhaust composition, storage means responsive to each of the changes in concentration level to provide an output representative of the number of the changes per unit time; and wherein said means responsive to changes in concentration level comprises a differentiating circuit, said storage means comprises a capacitor and diode connected between said differential circuit and said capacitor to charge the capacitor with the differentiated signal of a given polarity.

6. Emission control apparatus as claimed in claim 5, wherein said first and second signal generating means comprises an amplifier having first and second input terminals and an output terminal, the first input terminal and the output terminal being resistively connected together, said first input terminal being resistively connected to the outputs of said exhaust composition sensing means, said second input terminal being biased at a reference potential.

7. Emission control apparatus as claimed in claim 5, wherein said means for generating first and second control signals comprises an operational amplifier having first and second input terminals and an output terminal, a switched resistor network having first and second resistance values connected between the first input terminal and the output terminal of said operational amplifier, means for switching from said first to second resistance values in response to said detecting means, the second input terminal of said operational amplifier being biased at a reference potential and the first input being connected resistively to the outputs of said exhaust composition sensing means associated with said exhaust systems, said first resistance value being such that said operational amplifier delivers an output whose amplitude is a mean value of the amplitudes of the outputs from said exhaust composition sensing means when said network has said first resistance value, and said second resistance value being such that said operational amplifier has a unity gain when said network has the second resistance value.

* * * * *